US005243720A

United States Patent [19]

Harrow

[11] Patent Number: 5,243,720

[45] Date of Patent: Sep. 14, 1993

[54] KNOCK-DOWN BED FRAME WITH BOX SPRING SUPPORT

[76] Inventor: Larry M. Harrow, 945 S. Birch St., Los Angeles, Calif. 90021

[21] Appl. No.: 977,624

[22] Filed: Nov. 17, 1992

[51] Int. Cl.[5] ..... A47C 19/00; A47C 19/02

[52] U.S. Cl. ..... 5/201; 5/411

[58] Field of Search ..... 5/201, 200.1, 411, 193, 5/207, 282.1

[56] References Cited

U.S. PATENT DOCUMENTS

| | | | |
|---|---|---|---|
| 3,713,181 | 1/1973 | Hougland | 5/201 |
| 3,760,437 | 9/1973 | Hooker | 5/201 |
| 4,430,763 | 2/1984 | Whitehead | 5/200.1 |
| 4,554,692 | 11/1985 | Whitehead | 5/411 |

FOREIGN PATENT DOCUMENTS

| | | | |
|---|---|---|---|
| 526687 | 3/1954 | Belgium | 5/201 |

*Primary Examiner*—Alexander Grosz

[57] ABSTRACT

A bed frame 10 including a side bar 12 and a cross bar 14 is adapted to be manually connected and disconnected without the use of screw-type fasteners and the like. The side bar 12 has a pair of generally flat elongated elements joined so that these elements form a right angle, and a pair of right angle connectors 20 and 22 connected to an inside surface 18*a* of one of the side bar elements 18. The cross bar 14 has a support brace 32 which is disposed at a right angle to the side bar 12 when the side bar 12 and cross bar 14 are connected and a bracket 38 attached to an end of the support brace 32. The bracket 38 has a pair of openings 26 positioned to be in registration with the connectors 20 and 22 when the side bar 12 and cross bar 14 are connected. A box spring positioning member 15 is attached to the side bar 12 in a manner to be manually moved between first and second positions by sliding over the outside surface 16*b* along a predetermined, linear path where first and second spaced holes 72 and 74 are disposed. A finger 80 moves into the inner hole 72 upon being manually moved from the second position to the first position and moves into the outer hole 74 upon being manually moved from the first position to the second position.

19 Claims, 4 Drawing Sheets

KNOCK-DOWN BED FRAME WITH BOX SPRING SUPPORT

BACKGROUND OF THE INVENTION

1. Field of the Invention

This invention relates to a bed frame which is easy to assemble and disassemble, is ruggedly constructed, and has an adjustable box springs positioning member.

2. Background Discussion

Bed frames are commonly used devices to support box springs and mattresses. Typically, such bed frames include a pair of side bars, which are connected together by a pair of cross bars having downward extending feet, so that the box spring and mattress resting on the frame are elevated about 4 to 8 inches above the floor. The cross bars and side bars are made from angle irons, and there are various ways of attaching them together to provide an unitary structure which can be assembled and disassembled. It is conventional practice to use screw-type fasteners to connect the side bars and cross bars.

SUMMARY OF THE INVENTION

It is the objective of this invention to provide a bed frame which is easy to assemble and disassemble without the need for screw-type fasteners and the like, and includes an adjustable box spring positioning device.

The device of this invention has several features, no single one of which is solely responsible for its desirable attributes. Without limiting the scope of this invention as expressed by the claims which follow, its more prominent features will now be discussed briefly. After considering this discussion, and particularly after reading the section entitled, "DETAILED DESCRIPTION OF THE PREFERRED EMBODIMENT," one will understand how the features of this invention provide its advantages, which include rugged construction, and simplicity and convenience of use.

A distinguishing feature of the bed frame of this invention is that it includes a side bar and a cross bar adapted to be manually connected and disconnected without the need for screw-type fasteners. This is accomplished through a unique connector structure having interactive components built into both the side bar and cross bar.

Specifically, the side bar has a pair of generally flat elongated elements, joined so that they form a right angle. There is an elongated orifice in one element which has a central longitudinal axis disposed generally at a right to the outside edges of this element. A pair of connectors are connected to the inside surface of the other element which extend outward generally at a right angle. Each of these connectors has a shaft portion which terminates in an enlarged terminal end portion. The connectors are disposed below the elongated orifice, with one of the connectors on each side of the elongated orifice, so that the connectors are approximately at equal distances from the central axis of the elongated orifice. The cross bar has a support brace which is disposed at a right angle to the side bar when the side bar and cross bar are connected. There is a bracket member attached to an end of the support brace, and this bracket member has a pair of generally flat elongated elements, joined so that they form a right angle. When the side bar and cross bar are connected, the bracket nests inside the side bar, and a raised head section on an attachment piece on the bracket is received in the elongated orifice. A pair of openings in the bracket along the junction of the bracket elements are positioned to be in registration with the connectors when the side bar and cross bar are connected.

There are several important features of the connector structure. First, the elongated orifice has opposed ends and the head section of the attachment piece comprises a pair of rivets, each having a raised head, with each head bearing against one of the opposed ends of the elongated orifice when the side bar and cross bar are connected. Second, each of the openings in the bracket have an enlarged entryway and a narrow locking section which has a width slightly greater than the thickness of the shaft portions of the connectors to enable the terminal end portions of the connectors to slide into the openings with the shaft portions fitting snug within the narrow locking sections and the terminal end portions bearing against the inside surface of the bracket element. Third, the shaft portions have a length slightly longer than the thickness of the bracket element and a wedge member extends outward from the outside surface of the bracket member which in forced against the inside surface of the side bar element when the side bar and cross bar are connected. This provides a tight, nesting fit between the inside surfaces of the side bar elements against the outside surfaces of the bracket elements. The wedge member preferably comprises a pair of spaced apart conical dimples formed in the bracket element. Fourth, the dimples are disposed below the elongated orifice, with one of the dimples on each side of the elongated orifice. The dimples are approximately at equal distances from the central axis of the elongated orifice. The dimples are disposed inside the connectors when the side bar and cross bar are connected. Fifth, the raised head section has a height approximately equal to the thickness of the side bar element so that the head section is essentially flush with the outside surface of the side bar element when the side bar and cross bar are connected.

Another distinguishing feature of the bed frame of this invention is that it includes an adjustable box spring positioning member. This member is connected to the side bar of the bed frame side bar, and there are first and second spaced apart holes in the top element of the side bar lying along a predetermined, linear path that is at a right angle to the edges of the top element. The positioning member is attached to the outside surface of the top element to be manually moved between first and second positions by sliding the positioning member over these outside surface along the linear path. The positioning member has a generally flat bearing member having at an outer end a raised arm adapted to engage the box spring and a finger section extending outward from the bearing member towards the outside surface of the side bar element. The raised arm is generally at a right to the bearing member. The finger section moves into the first hole upon being manually moved from the second position to the first position and moves into the second hole upon being manually moved from the first position to the second position. Preferably, the finger section is formed integral with the bearing member by punching it from a section of said bearing member. There are means provided for attaching the positioning member to the support surface which include a pair of spaced apart, parallel, elongated slots in the support surface. A pair of legs extend downward from the bearing member which are received in the slots. These legs each have a retaining member at an end to retain the positioning member on the support surface and allow the bearing member to lift off the support member. This permits withdrawal of the finger section from a hole to enable sliding movement of the positioning member between the first and second positions.

BRIEF DESCRIPTION OF THE DRAWING

The preferred embodiment of this invention, illustrating all its features, will now be discussed in detail. This embodiment depicts the novel and non-obvious bed frame of this invention shown in the accompanying drawing, which is for illustrative purposes only. This drawing includes the following figures (FIGS.), with like numerals indicating like parts.

DESCRIPTION OF THE PREFERRED EMBODIMENT

Figure 1:
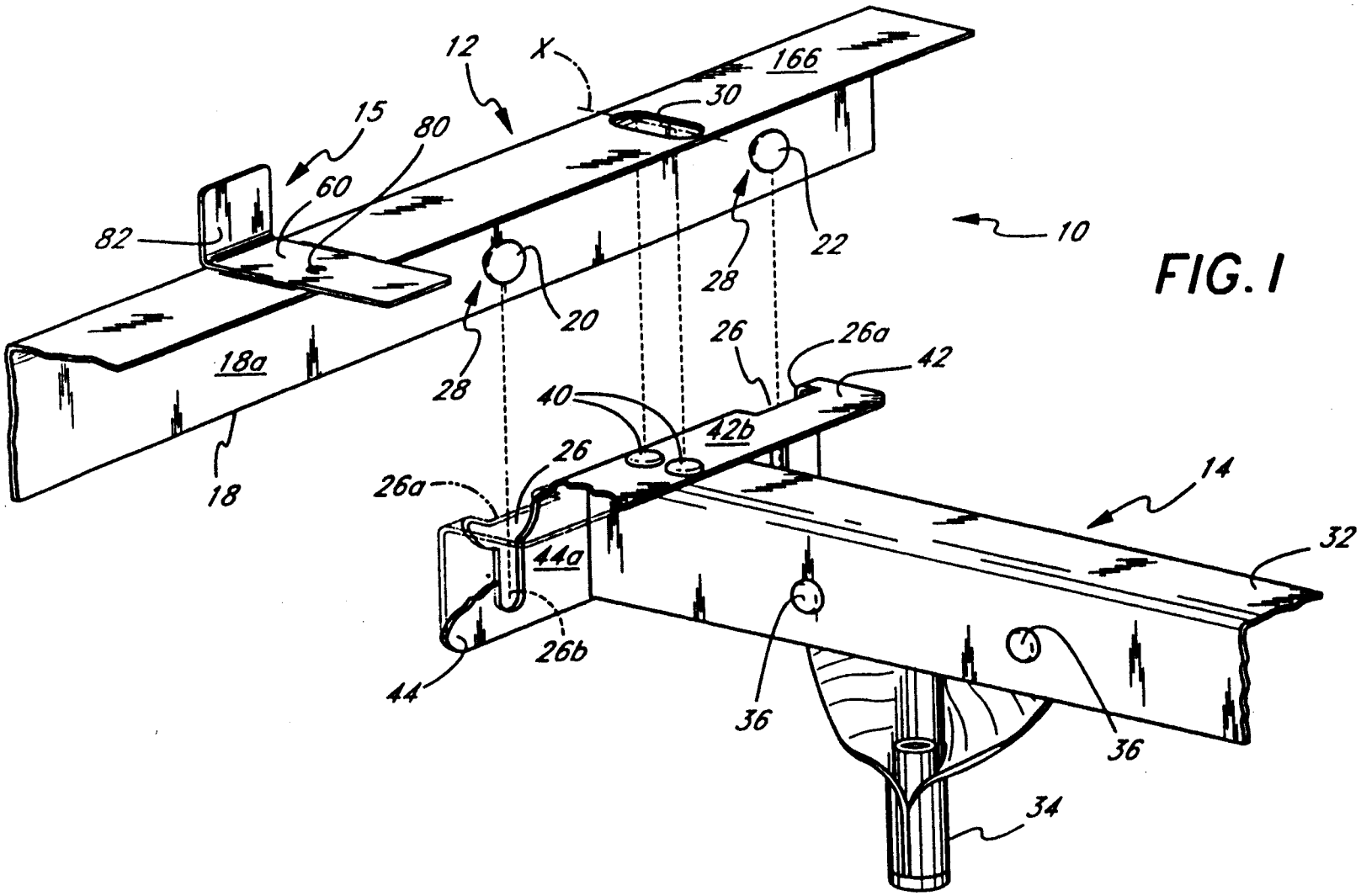
FIG. 1 is an exploded perspective view of the bed frame of this invention.
Figure 7A:
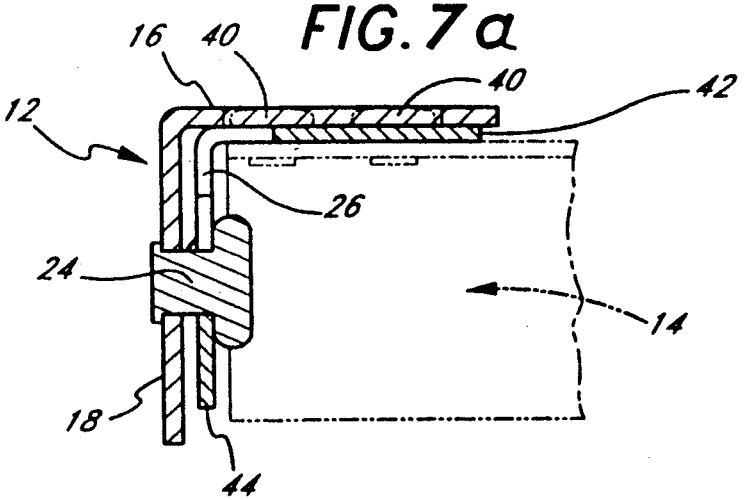
FIG. 7*a* is a cross-sectional view taken along line 7*a*—7*a* of FIG. 7.
Figure 7B:
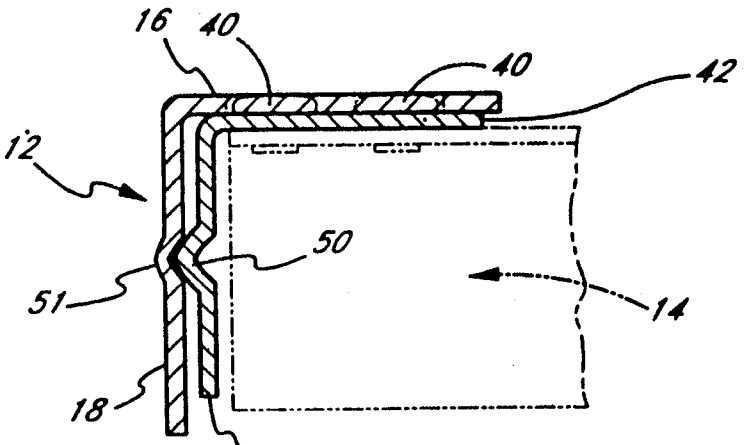
FIG. 7*b* is a cross-sectional view taken along line 7*b*—7*b* of FIG. 7.
Figure 7:
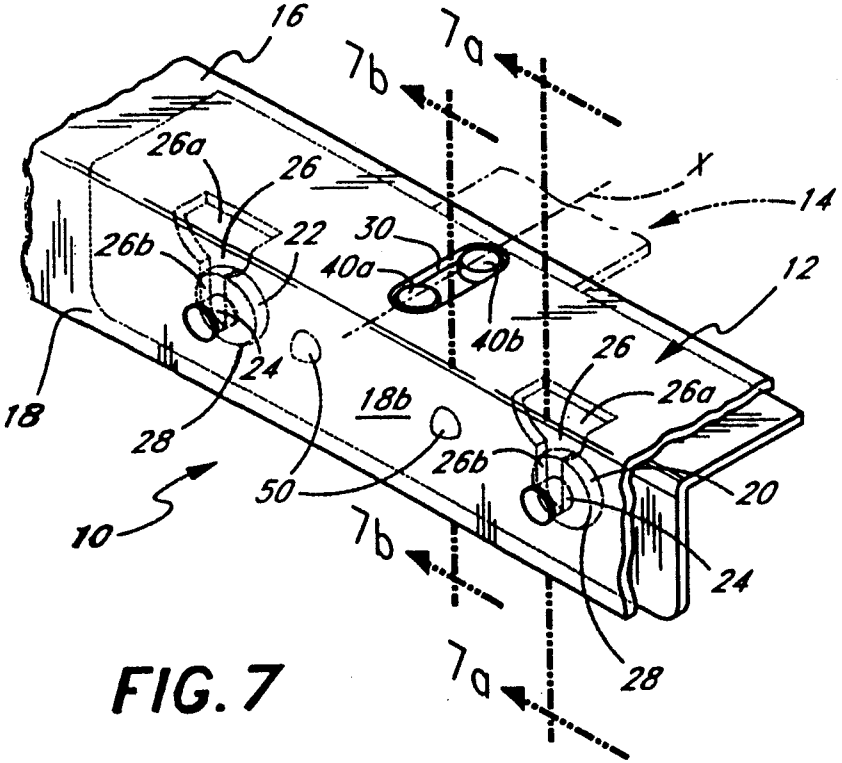
FIG. 7 is a perspective view of the bed frame of this invention with the side bar and cross bar assembled.

As illustrated in FIG. 1, the bed frame 10 of this invention includes a side bar 12 and a cross bar 14 which are adapted to be easily connected and disconnected without the need for screw-type fasteners. Upon being connected together, the side bar 12 and cross bar 14 nest together as illustrated in FIG. 7. The bed frame 10 has attached to the side bar 12 a box spring positioning member 15.

The side bar 12 is preferably an angle iron having a top element 16 and a side element 18 joined together along a common edge to form a right angle between the top element and the side element. These elements 16 and 18 each have inside surfaces 16*a* and 18*a*, respectively, and outside surfaces 16*b* and 18*b*, respectively. Along the inside surface 18*a* of the side element 18 are a pair of spaced apart connectors 20 and 22. Each connector 20 and 22 is rigidly attached to the side element 18 and is riveted in position. Each includes a shaft 24 extending outward from the inside surface 18*a* of the side element 18 and terminating in an enlarged head 28 at the end of the shaft 24 which are received in openings 26 in a bracket 38 attached to the cross bar 14. There is an elongated orifice 30 in the top element 16 disposed about midway between the connectors 20 and 22, so that the connectors are below and equidistant from the longitudinal axis x of the orifice 30. The top element 16 will have a length corresponding approximately to the length of the box spring mattress, and a width approximately 1 to 3 inches. The side element 18 has a length equal to the top element, and it has a width approximately 1 to 3 inches. Each of these elements 16 and 18 has a thickness of approximately ¼ inch and are made from an iron angle bar.

The cross bar 14 includes a brace 32 in the form of an angle iron and includes a foot member 34 attached by rivets 36 to an outer portion of the brace 32. The bracket 38 is attached by a pair of rivets 40, which rigidly connect the bracket 38 to the end of the brace 32. The bracket 38 has a top element 42 and a side element 44 joined along a common edge. Each of these elements 42 and 44 have, respectively, inside surfaces 42*a* and 44*a* and inside surfaces 42*b* and 44*b*. The rivets 40 provide two spaced apart heads 40*a* and 40*b* which fit upon assembly of the side bar 12 and cross bar 14 snugly within the elongated orifice 30, which each head 40*a* and 40*b* bearing against an opposite end of the orifice upon assembly as illustrated in FIG. 7.

The pair of spaced apart openings 26 are along the junction between the top element 42 and side element 44, and they which are in registration with the connectors 20 and 22. Each of these openings 26 has an enlarged entryway 26*a* which tapers downward into a narrow locking section 26*b*. These entryways 26*a* extend into both the top element 42 and side element 44 of the bracket 38. Upon assembly of the side bar 12 and cross bar 14, the heads 28 are aligned with the openings 26, being positioned above the entryways 26*a*. The side bar 12 and cross bar 14 are joined together by slipping the heads 28 into the entryways 26*a* and then into the narrow locking section 26*b*, with the heads bearing against the inside surface 44*a* of the side element 44 of the cross bracket 38 and the shafts 24 being positioned within the narrow locking sections. The lengths of the shafts 24 are only slightly longer than the thickness of the bracket side element 44. There is, however, some play or space between the outside surface 44*b* of the bracket side element 44 and the inside surface 18*a* of the side bar side element 18. As best shown in FIG. 7*b*, a pair of spaced apart conical dimples 50 extend outwardly from the bracket side element 44. In the inside surface 18*a* of the side element 18 are a pair of conically shaped receptacles 51 which are directly opposite and receive the dimples 50 upon assembly. The dimples 50 fit within the receptacles 51 to provide a snug, nesting fit between the engaging surfaces of bracket 38 and side bar 12 as illustrated in FIG. 7.

Figures 2, 3, 4:
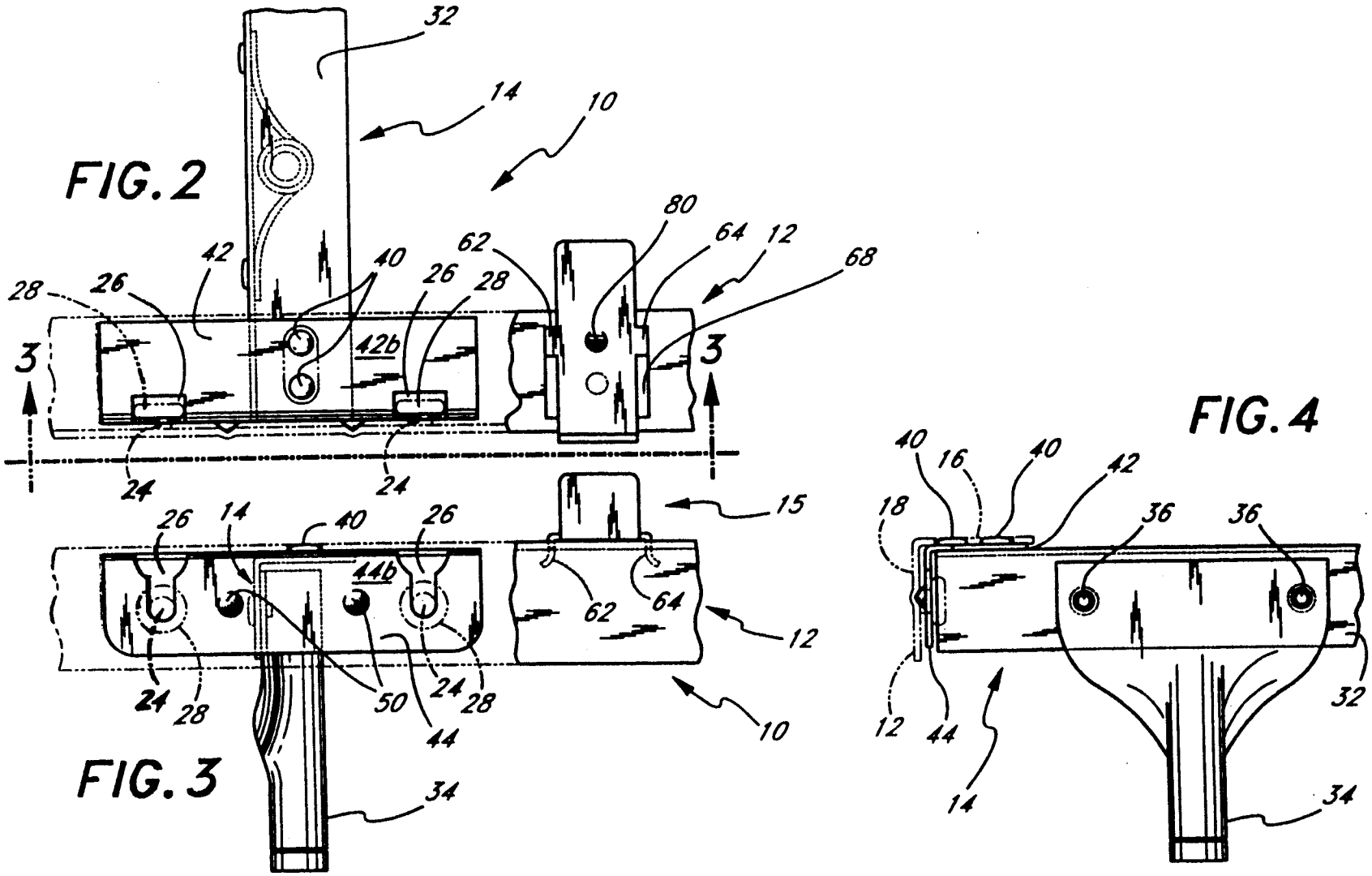
FIG. 2 is a top plan view of an assembled side bar and cross bar of the bed frame shown in FIG. 1, with sections of the side bar broken away.
FIG. 3 is a cross-sectional view taken along line 3—3 of FIG. 2.
FIG. 4 is a side-elevational view of the cross bar, with the side bar shown in phantom lines.
Figure 5:
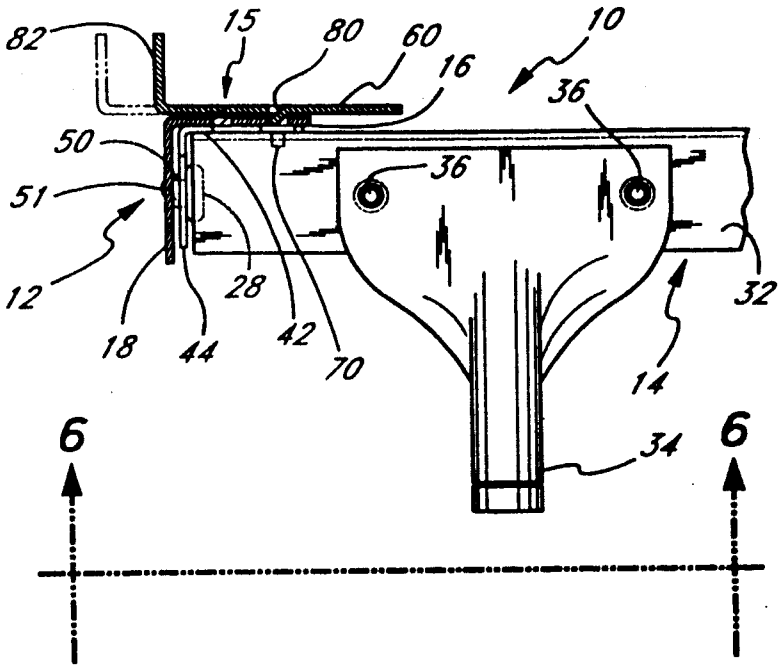
FIG. 5 is a cross-sectional view taken along line 5—5 of FIG. 6.
Figure 6:
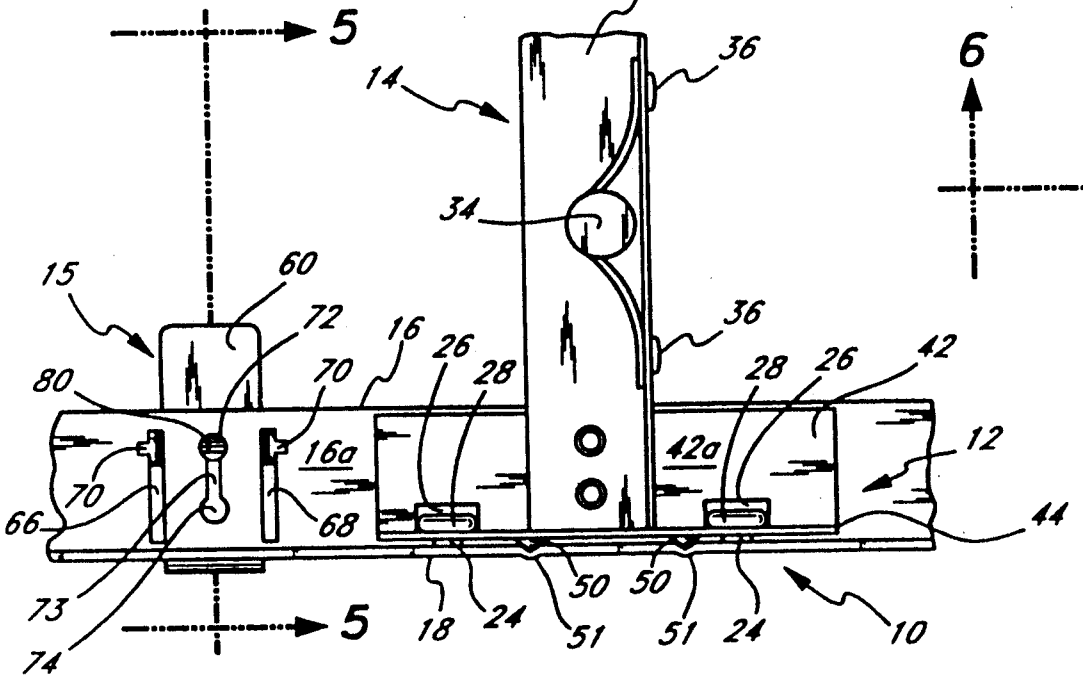
FIG. 6 is a plan view of the underside of the assembled bed frame depicted in FIG. 3, taken along line 6—6 of FIG. 5.

The box spring positioning member 15 is mounted on the top element 16 to move along a linear path across the outside surface 16*b* between two different positions as best depicted in FIG. 5. One position is shown in solid lines, and the other position is shown in dotted lines. This positioning member 15 includes a bearing member 60 having a pair of opposed legs 62 and 64 extending downward, respectively, into two opposed slots 66 and 68 (FIG. 2) in the side bar top element 16. Each of these legs 62 and 64 has a retainer knuckle 70 (FIGS. 5 and 6) that engages the inside surface 16*a* of the top element 16. The top element 16 has a pair of aligned holes 72 and 74 (FIG. 6) spaced apart approximately ¼ to ¾ inch. A narrow channel 73 that lies along the linear path provides a guideway between the holes 72 and 74. There is a downward projecting finger 80 (FIGS. 2, 5 and 6) which is punched into the bearing member 60 to provide an angular relationship between the outside surface 16*b* and the finger 80 of approximately 30 to 60 degrees. There is sufficient space between the retainer knuckles 70 and the inside surface 16*a* of the side bar top element 16, so that there is movement up and down of the positioning member 15, allowing the finger 80 to disengaged from one hole 72, and then, upon movement of the member 15 to the position shown in dotted lines in FIG. 5, to slide along the channel 73 and drop down into the second hole 74, and vice versa. An upwardly extending arm 82 at a right angle to the bearing member 60 provides a stop for the edge of a box spring (not shown).

The bed frame 10 of this invention is easy to use. The user simply grasps the cross bar 14 in one hand and the side bar 12 in the other, aligns the rivet heads 40 with the elongated orifice 30 and the connectors 20 and 22 with the entryways 26*a* of the openings 26, and pushes the cross bar 14 into position as depicted in FIGS. 5 and 7, nesting the bracket 38 of the cross bar 14 against the inside surfaces 16*a* and 18*a* of the side bar 12. The dimples 50 act as wedges which force the outside surface 42*b* of the top element 42 of the bracket 38 against the inside surface 16*a* of the top element 16 of the side bar 12. The cross bar 14 and side bar 12 are thus connected rigidly and securely together, but may be released by simply lifting up on the side bar 12, pulling the connectors 20 and 22 from the openings 26, and withdrawing the rivet heads 40 from the elongated orifice 30. The box spring positioning member 15 is moved initially to the position shown in dotted lines by lifting up on the bearing member 60, so that the finger 80 is withdrawn from the one hole 72. This allows the user to slide the bearing member 60 over the outside surface 16*b* of the side bar top element 16 to the position shown in dotted lines in FIG. 5. This brings the finger 80 into an overlying position relative to the other hole 74. Upon release of the bearing member 60, the finger 80 drops into and engages the edge of the hole 74. The box spring can now be positioned on the assembled bed frame 10. Its weight rests on the bearing member 60, holding the positioning member 15 in a relatively stable position. If the box spring is of a different width, the positioning member 15 may be left in the position shown in solid lines. Thus, the positioning member 15 engages the edge of the box spring, holding it in position on the frame 10. The position of positioning member 15 is selected on the basis of the width of the box spring.

SCOPE OF THE INVENTION

The above presents a description of the best mode contemplated of carrying out the present invention, and of the manner and process of making and using it, in such full, clear, concise, and exact terms as to enable any person skilled in the art to which it pertains to make and use this invention. This invention is, however, susceptible to modifications and alternate constructions from that discussed above which are fully equivalent. Consequently, it is not the intention to limit this invention to the particular embodiment disclosed.

On the contrary, the intention is to cover all modifications and alternate constructions coming within the spirit and scope of the invention as generally expressed by the following claims, which particularly point out and distinctly claim the subject matter of the invention:

1. A bed frame including a side bar and a cross bar adapted to be manually connected and disconnected, said side bar having first and second generally flat elongated elements, said first and second elements each having an outside surface, an inside surface, and an outside elongated edge, with the outside edges joined so that said first and second elements form a right angle, said first element being disposed above said second element generally horizontally when the side bar and cross bar are connected, an elongated orifice in the first element having a central longitudinal axis disposed generally at a right to said outside edges, a pair of connectors connected to the inside surface of the second element which extend outward generally at a right angle, each of said connectors having a shaft portion which terminates in an enlarged terminal end portion, with said connectors being disposed below the elongated orifice, with one of said connectors on each side of said elongated orifice, and said connectors being approximately at equal distances from the central axis of the elongated orifice, said cross bar having a support brace which is disposed at a right angle to the side bar when said side bar and cross bar are connected and a bracket member attached to an end of the support brace, said bracket member having third and fourth generally flat elongated elements each having an outside surface, an inside surface, and an outside elongated edge, with the outside edges joined so that said third and fourth elements form a right angle with said third element being disposed above said fourth element generally horizontally, and when the side bar and cross bar are connected, said third element being beneath and in engagement with the inside surface of the first element and said fourth element being adjacent the inside surface of the second element, said third element overlying the end of the support brace and being attached to said bracket by attachment means having a raised head section that is received in the elongated orifice when the side bar and cross bar are connected, said fourth element having a pair of openings therein along the edges where the third and fourth elements are joined together which are positioned to be in registration with said connectors when the side bar and bar are connected, each of said openings having an enlarged entryway and a narrow locking section which has a width slightly greater than the thickness of the shaft portions of the connectors to enable the terminal end portions of the connectors to slide into the openings with the shaft portions fitting snug within the narrow locking sections and the terminal end portions bearing against the inside surface of the fourth element, said shaft portions having a length slightly longer than the thickness of the fourth element, and a wedge member extending outward from the outside surface of the fourth element which in forced against the inside surface of the second element when the side bar and cross bar are connected to provide a tight, nesting fit between the inside surfaces of the first and second elements against the outside surfaces of the third and fourth elements.

2. The bed frame of claim 1 where the raised head has a height approximately equal to the thickness of the first element so that the head section is essentially flush with the outside surface of the first element when the side bar and cross bar are connected.

3. The bed frame of claim 2 where the elongated orifice has opposed ends and the attachment means comprises a pair of rivets, each having a raised head, with each head bearing against one of the opposed ends of the elongated orifice when the side bar and cross bar are connected.

4. The bed frame of claim 1 where the wedge member comprises a pair of spaced apart dimples formed in the fourth element, with said dimples being disposed below the elongated orifice, with one of said dimples on each side of said elongated orifice, and said dimples being approximately at equal distances from the central axis of the elongated orifice.

5. The bed frame of claim 4 where the dimples are disposed inside the connectors when the side bar and cross bar are connected.

6. A bed frame adapted to support a box spring including an elongated side bar having a generally flat support surface with inside and outside edges and first and second spaced apart holes therein lying along a predetermined path that is at a right angle to said edges, a box spring positioning member attached to the support surface to be manually moved between first and second positions by sliding said positioning member over said support surface along said path, said positioning member having a generally flat bearing member having at an outer end a raised arm adapted to engage the box spring and a finger section extending outward from the bearing member towards the support surface, said finger section moving into the first hole upon being manually moved from the second position to the first position and moving into the second hole upon being manually moved from the first position to the second position.

7. The bed frame of claim 6 including means for attaching the positioning member to the support surface comprising a pair of spaced apart, parallel, elongated slots in the support surface, and a pair of legs extending downward from the bearing member which are received in the slots, said legs each having an retaining member at an end to retain the positioning member on the support surface and allow the bearing member to lift off the support member to permit withdrawal of the finger section from a hole to enable sliding movement of said positioning member between said first and second positions.

8. The bed frame of claim 6 where the finger section is formed integral with the bearing member by punching it from a section of said bearing member.

9. The bed frame of claim 6 where the raised arm is generally at a right to the bearing member.

10. A bed frame adapted to support a box spring including a side bar and a cross bar adapted to be manually connected and disconnected, said side bar having first and second generally flat elongated elements, said first and second elements each having an outside surface, an inside surface, and an outside elongated edge, with the outside edges joined so that said first and second elements form a right angle, said first element being disposed above said second element generally horizontally when the side bar and cross bar are connected and having therein first and second spaced apart holes lying along a predetermined path that is at a right angle to said outer edge of said first element, an elongated orifice in the first element having a central longitudinal axis disposed generally at a right angle to said outside edges, a pair of connectors connected to the inside surface of the second element which extend outward generally at a right angle, each of said connectors having a shaft portion which terminates in an enlarged terminal end portion, with said connectors being disposed below the elongated orifice, with one of said connectors on each side of said elongated orifice, and said connectors being approximately at equal distances from the central axis of the elongated orifice, said cross bar having a support brace which is disposed at a right angle to the side bar when said side bar and cross bar are connected and a bracket member attached to an end of the support brace, said bracket member having third and fourth generally flat elongated elements, each having an outside surface, an inside surface, and an outside elongated edge, with the outside edges joined so that said third and fourth elements form a right angle, and when the side bar and cross bar are connected, said third element being disposed above said fourth element generally horizontally and being beneath and in engagement with the inside surface of the first element and said fourth element being adjacent the inside surface of the second element, said third element overlying the end of the support brace and being attached to said bracket by attachment means having a raised head section that is received in the elongated orifice when the side bar and cross bar are connected, said fourth element having a pair of openings therein along the edges where the third and fourth elements are joined together which are positioned to be in registration with said connectors when the side bar and cross bar are connected, each of said openings having an enlarged entryway and a narrow locking section which has a width slightly greater than the thickness of the shaft portions of the connectors to enable the terminal end portions of the connectors to slide into the openings with the shaft portions fitting snugly within the narrow locking sections and the terminal end portions bearing against the inside surface of the fourth element, said shaft portions having a length slightly longer than the thickness of the fourth element, a wedge member extending outward from the outside surface of the fourth element which in forced against the inside surface of the second element when the side bar and cross bar are connected to provide a tight, nesting fit between the inside surfaces of the first and second elements against the outside surfaces of the third and fourth elements, and a box spring positioning member attached to the outside surface of the first element in a manner to be manually moved between first and second positions by sliding said positioning member over said outside surface along a path, said positioning member having a generally flat bearing member having at an outer end a raised arm adapted to engage a box spring and a finger section extending outward from the bearing member towards the outside surface of the first element, said finger section moving into the first hole upon being manually moved from the second position to the first position and moving into the second hole upon being manually moved from the first position to the second position.

11. The bed frame of claim 10 where the raised head section has a height approximately equal to the thickness of the first element so that the head section is essentially flush with the outside surface of the first element when the side bar and cross bar are connected.

12. The bed frame of claim 11 where the elongated orifice has opposed ends and the attachment means comprises a pair of rivets, each having a raised head, with each head bearing against one of the opposed ends of the elongated orifice when the side bar and cross bar are connected.

13. The bed frame of claim 10 where the wedge member comprises a pair of spaced apart dimples formed in the second element, with said dimples being disposed below the elongated orifice, with one of said dimples on each side of said elongated orifice, and said dimples being approximately at equal, distances from the central axis of the elongated orifice.

14. The bed frame of claim 13 where the dimples are disposed inside the connectors when the side bar and cross bar are connected.

15. The bed frame of claim 10 including means for attaching the positioning member to the support surface comprising a pair of spaced apart, parallel, elongated slots in the support surface, and a pair of legs extending downward from the bearing member which are received in the slots, said legs each having an retaining member at an end to retain the positioning member on the support surface and allow the bearing member to lift off the support member to permit withdrawal of the finger section from a hole to enable sliding movement of said positioning member between said first and second positions.

16. The bed frame of claim 10 where the finger section is formed integral with the bearing member by punching it from a section of said bearing member.

17. The bed frame of claim 10 where the raised arm is generally at a right to the bearing member.

18. A bed frame including a side bar and a cross bar adapted to be manually connected and disconnected without the use of screw-type fasteners and the like, said side bar having a connector with a shaft portion, and an enlarged terminal end portion, said cross bar having a support brace which is disposed at a right angle to the side bar when said bar and cross bar are connected and a bracket member attached to an end of the support brace, said side bar and bracket member each having a pair of generally flat elongated elements joined to form a right angle, so that upon connection the bracket nests inside the side bar elements, one of said bracket elements having an opening positioned to be in registration with the connector when the side bar and cross bar are connected, said opening having an enlarged entryway and a narrow locking section which has a width slightly greater than the thickness of the shaft portion of the connector to enable the terminal end portion of the connector to slide into the opening with the shaft portion fitting snug within the narrow locking section and the terminal end portion bearing against the inside surface of one of said bracket elements, said shaft portion having a length slightly longer than the thickness of said one element, a box spring positioning member attached to an outside surface of a side bar element in a manner to be manually moved between first and second positions by sliding said positioning member over said outside surface along a predetermined path where first and second spaced holes in said element are disposed, said positioning member having a generally flat bearing member having at an outer end a raised arm adapted to engage the box spring and a finger section extending outward from the bearing member towards the outside surface of said side bar element, said finger section moving into the first hole upon being manually moved from the second position to the first position and moving into the second hole upon being manually moved from the first position to the second position.

19. The bed frame of claim 18 including a wedge member extending outward from one of said elements which in forced against the inside surface of the other element when the side bar and cross bar are connected to provide a tight, nesting fit between the side bar and bracket.

* * * * *

UNITED STATES PATENT AND TRADEMARK OFFICE

CERTIFICATE OF CORRECTION

PATENT NO. : 5,243,720
DATED : September 14, 1993
INVENTOR(S) : Larry M. Harrow

It is certified that error appears in the above-indentified patent and that said Letters Patent is hereby corrected as shown below:

Column 4, line 32, insert --bar-- after "cross"

IN THE CLAIMS:

Column 6, line 33, insert --to-- after "adjacent"
Column 6, line 56, change "which in" to --which is--
Column 6, line 62, insert --section-- after "head"
Column 7, line 43, change "an retaining" to --a retaining--
Column 8, line 29, insert --to-- after "adjacent"
Column 8, line 53, change "which in" to --which is--
Column 9, line 37, change "an retaining" to --a retaining--
Column 10, line 46, change "which in" to --which is--

Signed and Sealed this

Sixth Day of September, 1994

*Attest:*

*Attesting Officer*

Bruce Lehman

BRUCE LEHMAN

*Commissioner of Patents and Trademarks*